US008490963B2

(12) United States Patent
Miyahara

(10) Patent No.: US 8,490,963 B2
(45) Date of Patent: Jul. 23, 2013

(54) IMAGE FORMING APPARATUS, SHEET FEED CONTROL METHOD, AND STORAGE MEDIUM

(75) Inventor: Nobuaki Miyahara, Yokohama (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/172,150

(22) Filed: Jun. 29, 2011

(65) Prior Publication Data

US 2012/0001377 A1 Jan. 5, 2012

(30) Foreign Application Priority Data

Jul. 1, 2010 (JP) ..... 2010-151105

(51) Int. Cl.
*B65H 5/26* (2006.01)

(52) U.S. Cl.
USPC ..... 271/9.06; 271/9.09; 399/389

(58) Field of Classification Search
USPC ..... 271/9.06, 9.09; 399/370, 376, 389, 399/391
See application file for complete search history.

(56) References Cited

U.S. PATENT DOCUMENTS

| | | | | |
|---|---|---|---|---|
| 6,526,253 | B2 * | 2/2003 | Hayashi et al. | 399/391 |
| 6,876,824 | B2 * | 4/2005 | Maeda | 399/82 |
| 7,284,753 | B2 * | 10/2007 | Kotani | 271/9.06 |
| 8,396,409 | B2 * | 3/2013 | Azami et al. | 399/389 |
| 2010/0080590 | A1 * | 4/2010 | Takahashi | 399/45 |

FOREIGN PATENT DOCUMENTS

JP 2004-004622 A 1/2004

* cited by examiner

*Primary Examiner* — Jeremy R Severson
(74) *Attorney, Agent, or Firm* — Rossi, Kimms & McDowell LLP

(57) ABSTRACT

An image forming apparatus capable of printing a non-standard size image on a sheet of a size as desired by the user as possible, and preventing stoppage of printing the image even when there is no sheet of the size desired by the user in a sheet feeder. When image data is for a non-standard size, if there is a sheet feeder accommodating recording sheets of which vertical and lateral lengths corresponding to vertical and lateral lengths represented by the image data are designated, a control unit feeds the sheets from the sheet feeding cassette. If there is no such a sheet feeder, the control unit feeds recording sheets of a free size from a manual feed tray accommodating the recording sheets of the free size.

6 Claims, 9 Drawing Sheets

IMAGE FORMING APPARATUS, SHEET FEED CONTROL METHOD, AND STORAGE MEDIUM

BACKGROUND OF THE INVENTION

1. Field of the Invention

The present invention relates to an image forming apparatus, a sheet feed control method, and a storage medium storing a non-transitory computer-readable storage medium storing a computer-executable program for causing a computer to execute the sheet feed control method.

2. Description of the Related Art

In general, some image forming apparatus is provided with a plurality of sheet feeders (e.g. sheet feeding cassettes), for selectively feeding recording sheets (hereinafter also simply referred to as "sheets") from the sheet feeding cassettes. Further, some image forming apparatus is equipped with a so-called manual feed tray, which is another sheet feeder different from the sheet feeding cassettes.

Conventionally, when an image is to be printed on a non-standard size sheet using a color image forming apparatus, a user sets the manual feed tray to a user-defined size for the size of sheets, and causes the color image forming apparatus to perform printing. The term "user-defined size" is intended to mean a non-standard size in which the vertical and lateral lengths of a recording sheet are designated by the user.

In such a color image forming apparatus, when a request for printing an image having a non-standard size is received, a recording sheet is fed from the manual feed tray having the user-defined size set thereto, for printing the image. When the recording sheet is fed with the size of the recording sheet being unknown, if the size of the image is larger than the size of the sheet, an excess amount of a recording material (toner) beyond the range of the size of the sheet is scattered in the image forming apparatus. If the recording material is scattered in the image forming apparatus, the quality of an image formed thereafter is sometimes adversely affected by the scattered recording material. To eliminate this inconvenience, in the conventional color image forming apparatus, the scattering of the recording material is prevented by causing the user to designate the size of the sheet.

On the other hand, when an image is to be printed on a non-standard size sheet using a monochrome image forming apparatus, a user sets the sheet size of the manual feed tray to a so-called free size and causes the monochrome image forming apparatus to perform printing. The term "free size" is intended to mean a non-standard size in which the user does not designate the vertical and lateral lengths of a recording sheet. If the free size is used, it is not necessary for the user to set the size of a recording sheet used for the printing, thereby making it possible to save user's time and labor for setting the size of the sheet. Although the color image forming apparatus uses four color recording materials to form an image, the monochrome image forming apparatus uses only one color recording material to form an image. Therefore, in the monochrome image forming apparatus, it is possible to reduce the amount of scattered toner even when a sheet is fed from a sheet feeder set to the free size, and hence the monochrome image forming apparatus is configured to permit the free size to be set. In such a monochrome image forming apparatus, when a request for printing an image having a non-standard size is received, the image is printed by feeding a recording sheet from the manual feed tray set to the free size.

Further, as a conventional technique, there has been proposed a technique in which designation of the free size is permitted when performing monochrome printing having less possibility of scattering of toner, whereas when performing color printing, the user is required to designate a user-defined size (see e.g. Japanese Patent Laid-Open Publication No. 2004-4622).

In the conventional image forming apparatus, however, it is impossible to set in advance a plurality of accommodating units, such as the sheet feeding cassettes and the manual feed tray, to respective non-standard sizes different from each other. For example, it is impossible to set in advance the sheet feeding cassettes to user-defined sizes while setting the manual feed tray to a free size.

Therefore, when a request for printing a non-standard size image is received, the conventional image forming apparatus suffers from the following problems:

In a case where the manual feed tray has been set to a user-defined size, if the vertical length and the lateral length of the user-defined size do not match those of sheets set in the manual feed tray, printing is stopped due to a sheet feeding error.

Further, in a case where the manual feed tray has been set to a free size, the image is sometimes not printed on a recording sheet of a size desired by the user since the size of the image requested to be printed does not necessarily match the size of recording sheets set in the manual feed tray.

SUMMARY OF THE INVENTION

The present invention provides a mechanism which makes it possible, upon reception of a request for printing a non-standard size image, to print the image on a sheet of a size as desired by the user as possible, and prevent printing the image from being stopped even when there is no sheet of the size desired by the user in a sheet feeder.

In a first aspect of the present invention, there is provided an image forming apparatus that selectively feeds recording sheets from a plurality of accommodating units to form an image on each of the recording sheets according to image data, comprising a first size designation unit configured to designate a standard size or a non-standard size for each of respective sizes of recording sheets accommodated in the accommodating units, a second size designation unit configured to designate vertical and lateral lengths of recording sheets, for the non-standard size, a third size designation unit configured to designate a free size in which vertical and lateral lengths of recording sheets are not designated, for the non-standard size, and a sheet feed control unit configured to be operable when the image data is associated with the non-standard size, to feed, if there is an accommodating unit accommodating recording sheets of which vertical and lateral lengths corresponding to vertical and lateral lengths represented by the image data are designated, a recording sheet from the accommodating unit, and feed, if there is no accommodating unit accommodating the recording sheets of which the vertical and lateral lengths corresponding to the vertical and lateral lengths represented by the image data are designated, a recording sheet from an accommodating unit accommodating recording sheets of the free size.

In a second aspect of the present invention, there is provided a sheet feed control method for an image forming apparatus that selectively feeds recording sheets from a plurality of accommodating units to form an image on each of the recording sheets according to image data, comprising designating a standard size or a non-standard size for each of respective sizes of recording sheets accommodated in the accommodating units, designating vertical and lateral lengths of recording sheets, for the non-standard size, designating a free size in which vertical and lateral lengths of recording sheets are not designated, for the non-standard size, and feeding, when the image data is associated with the non-standard size, if there is an accommodating unit accommodating recording sheets of which vertical and lateral lengths corresponding to vertical and lateral lengths represented by the image data are designated, a recording sheet from the accommodating unit, and feeding, if there is no accommodating unit accommodating the recording sheets of which the vertical and lateral lengths corresponding to the vertical and lateral lengths represented by the image data are designated, a recording sheet from an accommodating unit accommodating recording sheets of the free size.

In a third aspect of the present invention, there is provided a non-transitory computer-readable storage medium storing a computer-executable program for causing a computer to execute a sheet feed control method for an image forming apparatus that selectively feeds recording sheets from a plurality of accommodating units to form an image on each of the recording sheets according to image data, wherein the sheet feed control method comprises designating a standard size or a non-standard size for each of respective sizes of recording sheets accommodated in the accommodating units, designating vertical and lateral lengths of recording sheets, for the non-standard size, designating a free size in which vertical and lateral lengths of recording sheets are not designated, for the non-standard size, and feeding, when the image data is associated with the non-standard size, if there is an accommodating unit accommodating recording sheets of which vertical and lateral lengths corresponding to vertical and lateral lengths represented by the image data are designated, a recording sheet from the accommodating unit, and feeding, if there is no accommodating unit accommodating the recording sheets of which the vertical and lateral lengths corresponding to the vertical and lateral lengths represented by the image data are designated, a recording sheet from an accommodating unit accommodating recording sheets of the free size.

The features and advantages of the invention will become more apparent from the following detailed description taken in conjunction with the accompanying drawings.

DETAILED DESCRIPTION OF THE EMBODIMENTS

The present invention will now be described in detail below with reference to the accompanying drawings showing embodiments thereof.

Figure 1:
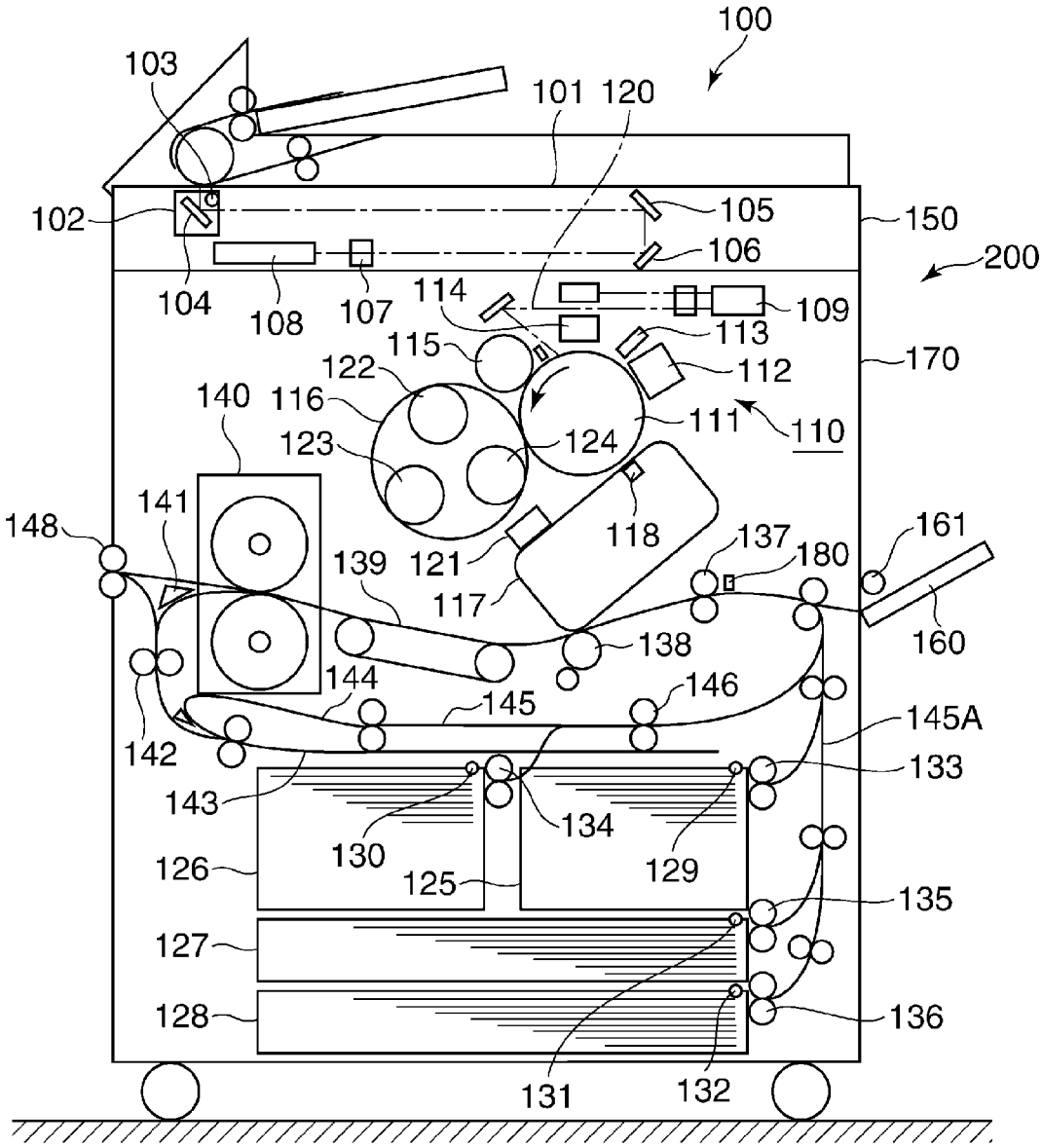
FIG. 1 is a cross-sectional view of an image forming apparatus according to a first embodiment of the present invention.

FIG. 1 is a cross-sectional view of an image forming apparatus 100 according to a first embodiment of the present invention.

Referring to FIG. 1, the illustrated image forming apparatus 100 is a color image forming apparatus which is capable of performing color printing. The image forming apparatus 100 includes a digital color image reader section (hereinafter simply referred to as the "reader section") 150, and a digital color image printer section (hereinafter simply referred to as the "printer section") 170. The reader section 150 is housed in an upper portion of a housing 200, and the printer section 170 is housed in a lower portion of the housing 200.

The reader section 150 comprises an original platen glass 101, a scanner 102, scanning mirrors 105 and 106, a lens 107, and a full-color image sensor section (hereinafter simply referred to as the "image sensor section") 108. The original platen glass 101 is used as a document support on which an original is placed, and the scanner 102 comprises an original illuminating lamp 103 and a scanning mirror 104.

The scanner 102 is driven by a motor (not shown), and is caused to reciprocate in predetermined directions (in left-right directions as viewed in FIG. 1) to scan an original. The original illuminating lamp 103 emits light for illuminating the original. When the original is irradiated with light from the original illuminating lamp 103, a reflected light image from the original is guided to the image sensor section 108 by the scanning mirrors 104 to 106 and the lens 107. The image sensor section 108 is integrally formed with three-color (R, G, and B) separation filters, and includes a CCD (charge coupled device) sensor, not shown.

In scanning an original placed on the original platen glass 101, the scanner 102 causes, while moving along one of the predetermined directions, a reflected light image from the original irradiated with light from the original illuminating lamp 103 to pass through the lens 107 via the scanning mirrors 104 to 106. Then, the reflected light image is formed on the CCD sensor of the image sensor section 108.

This causes the CCD sensor to generate a color separation image analog signal. This color separation image analog signal is amplified by an amplifier circuit, not shown, and then is digitized (converted into image data) by the CCD sensor, as described hereinafter.

The printer section 170 includes an image forming section 110. The image forming section 110 comprises an exposure controller 109, a photosensitive drum 111, a cleaning device 112, a pre-exposure lamp 113, a primary electrostatic charger 114, a black developing device 115, a rotary developing device 116, an intermediate transfer belt 117, a primary transfer charger 118, and a cleaning device 121.

The exposure controller 109 comprises a laser beam generator, a polygon scanner, and so forth, none of which are specifically shown. The exposure controller 109 generates a laser beam 120 modulated based on an image signal converted to an electric signal by the image sensor section 108 of the reader section 150 and further having undergone predetermined image processing, and irradiates the photosensitive drum 111 as an image bearing member with the laser beam 120.

The photosensitive drum 111 is driven for rotation by a motor (not shown) in a direction indicated by an arrow in FIG. 1. First, electric charge on the photosensitive drum 111 is eliminated by the pre-exposure lamp 113, and then is uniformly charged to a predetermined potential by the primary electrostatic charger 114. After that, the photosensitive drum 111 is irradiated with the laser beam 120 emitted from the exposure controller 109, whereby an electrostatic latent image is formed on the surface of the photosensitive drum 111.

The electrostatic latent image formed on the photosensitive drum 111 is developed by operating a predetermined developing device, to thereby form a toner image. The illustrated rotary developing device 116 includes developing devices 122, 123, and 124 associated with yellow (Y), magenta (M), cyan (C) colors, respectively.

In forming a toner image on the photosensitive drum 111, if the toner image is a color image, the rotary developing device 116 is rotated by a motor (not shown), and according to a color component to be developed, causes a sequentially selected one of the developing devices 122 to 124 to come closer to the photosensitive drum 111.

In developing a black toner, the black development device 115 disposed close to the photosensitive drum 111 is used. To form a monochrome image, only the black development device 115 is used.

The toner image on the photosensitive drum 111 is transferred onto the intermediate transfer belt 117 using high voltage applied by the primary transfer charger 118. To form a color image, toner images in four colors are transferred onto the intermediate transfer belt 117 in a superimposed relation to each other. To form a monochrome image, only a monochrome toner image is transferred onto the intermediate transfer belt 117.

Note that in the image forming apparatus 100 illustrated in FIG. 1, when there is used a recording sheet (hereinafter also simply referred to as a "sheet") of which the vertical length along the sheet feeding direction is not larger than half the circumference of the intermediate transfer belt 117, images can be simultaneously formed on areas of the intermediate transfer belt 117 which are associated with two recording sheets, respectively. After termination of primary transfer, residual toner remaining on the surface of the photosensitive drum 111 is removed by the cleaning device 112, and then an image forming process is carried out again.

Further, the printer section 170 comprises a secondary transfer roller 138, a sheet conveyance belt 139, a fixing device 140, a discharge flapper 141, a right sheet feeding cassette 125, a left sheet feeding cassette 126, an upper sheet feeding cassette 127, and a lower sheet feeding cassette 128. That is, the printer section 170 includes a plurality of sheet feeding cassettes, and as described hereinafter, sheets are fed from a selected one of the sheet feeding cassettes 125 to 128.

The sheet feeding cassettes 125 to 128 each accommodate recording sheets. The toner image formed on the intermediate transfer belt 117 is transferred onto a recording sheet fed from the selected one of the sheet feeding cassettes 125 to 128, as described hereinafter.

A pickup roller 129 picks up one of sheets accommodated in the right sheet feeding cassette 125 and a sheet feed roller 133 feeds the sheet to a sheet feed path 145A. Then, the sheet is conveyed by a registration roller 137 to a secondary transfer position where the toner image on the intermediate transfer belt 117 is transferred onto the sheet.

Similarly, a pickup roller 130 picks up one of sheets accommodated in the left sheet feeding cassette 126 and a sheet feed roller 134 feeds the sheet to a sheet feed path 145.

Further, a pickup roller 131 picks up one of sheets accommodated in the upper sheet feeding cassette 127 and a sheet feed roller 135 feeds the sheet to the sheet feed path 145A. A pickup roller 132 picks up one of sheets accommodated in the lower sheet feeding cassette 128 and a sheet feed roller 136 feeds the sheet to the sheet feed path 145A. These sheets are each conveyed to the secondary transfer position by the registration roller 137.

A sheet can also be fed from a manual sheet feeding tray (manual tray) 160. When an image is to be formed on an OHP (overhead projector) sheet, a non-standard size sheet, or a sheet the frequency of usage of which is relatively low, the sheet is fed mainly from the manual sheet feeding tray 160. The sheet feeding cassettes 125 to 128 and the manual sheet feeding tray 160 constitute sheet feeders provided in the image forming apparatus 100 according to the present embodiment.

The manual sheet feeding tray 160 is provided with guides 162 (see FIG. 3) for feeding sheets straight to the printer section 170 by a feed roller 161.

A sheet detecting sensor 180 is disposed immediately upstream of the registration roller 137. An approximate size of the vertical length of a sheet along the sheet feeding direction can be determined according to a time period (detection duration) over which the sheet is detected by the sheet detecting sensor 180. Therefore, even in the case of feeding non-standard size sheets, it is possible to calculate an approximate vertical length thereof. Note that in the present specification, the length of a sheet along the sheet conveying direction is referred to as the vertical length of the sheet, and the length of the sheet orthogonal to the vertical length is referred to as the lateral length of the sheet.

In the case of feeding the non-standard size sheets without designating the vertical and lateral lengths thereof, the sheet size of a first sheet fed is calculated. Further, to perform image formation on second and following sheets which are fed, the exposure controller 109 controls exposure based on the calculated sheet size of the first sheet such that exposure is not performed for portions, if present, where image data is unnecessary.

In the image forming section 110, after the toner image is transferred onto the intermediate transfer belt 117, a sheet conveyed from a selected one of the sheet feeding cassettes 125 to 128 is conveyed by the registration roller 137 to the secondary transfer roller 138 disposed at the secondary transfer position.

At the secondary transfer position, the toner image is transferred from the intermediate transfer belt 117 to the sheet (secondary transfer). After termination of the secondary transfer, residual toner remaining on the surface of the intermediate transfer belt 117 is removed by the cleaning device 121, whereafter the image forming process is carried out again.

After termination of the secondary transfer, the sheet is conveyed to the fixing device 140 by the sheet conveyance belt 139. Then, the sheet is pressurized and heated by the heat roller type fixing device 140, whereby the toner image transferred onto the sheet is fixed. After that, the sheet is discharged out of the image forming apparatus 100 by a discharge roller 148.

Note that the image forming apparatus 100 shown in FIG. 1 includes a double-sided printing function. In a double-sided printing mode, the discharge flapper 141 is switched such that a sheet is once conveyed to a reversing path 143 by a conveying roller 142. After that, the sheet is guided into a conveying path 144 from the reversing path 143, and is conveyed along the sheet feed path 145 by a roller 146. Then, the sheet reaches the secondary transfer position, at which an image is formed on the back side of the sheet. Thereafter, the sheet is conveyed through the fixing device 140 and is discharged out of the image forming apparatus 100 by the discharge roller 148.

Figure 2:
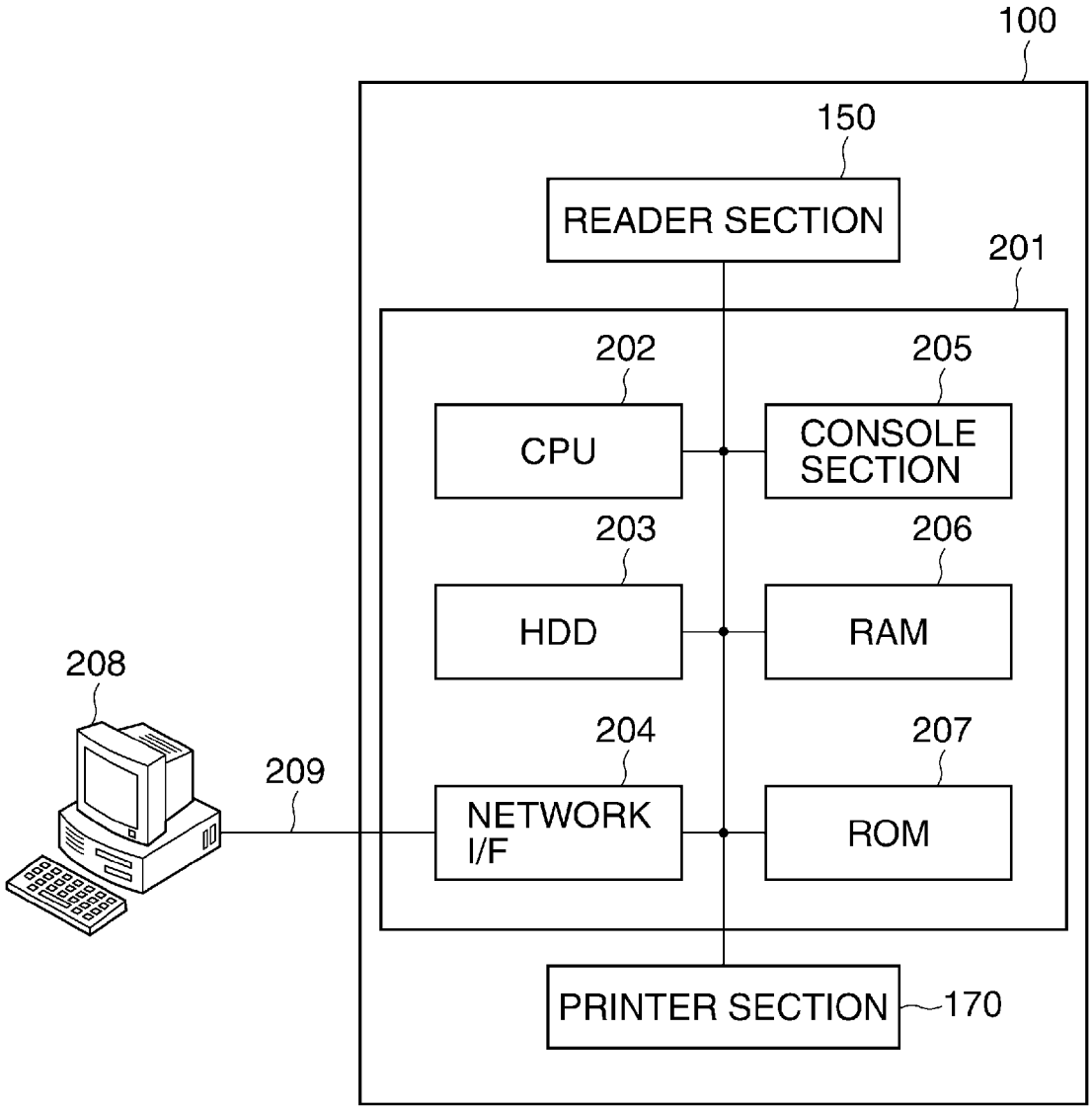
FIG. 2 is a block diagram of a control circuit used in the image forming apparatus shown in FIG. 1.

FIG. 2 is a block diagram of a control circuit (control unit) 201 used in the image forming apparatus shown in FIG. 1.

Referring to FIG. 2, the control unit 201 is electrically connected to the reader section 150 and the printer section 170. The control unit 201 comprises a CPU 202, an HDD (hard disk drive) 203, a network interface (I/F) 204, a console section 205, a RAM 206, and a ROM 207.

The CPU 202 starts the system of the image forming apparatus 100 based on a boot program stored in the ROM 207. The CPU 202 reads various control programs stored in the HDD 203 and the like, and executes various processes using the RAM 206 as a work area. The HDD 203 stores image data and the like together with the above-mentioned control programs.

The console section 205 includes a liquid crystal panel (not shown) equipped with a touch panel function for generating, when a user touches the liquid crystal panel e.g. with a finger, information for recognizing a user's instruction based on position information on a point of a screen of the panel touched by the user. Further, the console section 205 is provided with hard keys including ten keys and a start key. Furthermore, the console section 205 displays states of the image forming apparatus 100 and the like.

The network interface 204 is connected to a host computer 208 via a network 209, and a print job from the host computer 208 is sent to the image forming apparatus 100 via the network interface 204.

Although not shown, the right sheet feeding cassette 125, the left sheet feeding cassette 126, the upper sheet feeding cassette 127, the lower sheet feeding cassette 128, and the manual sheet feeding tray 160 are each provided with a sheet detecting sensor (detection switch) for detecting the presence/absence of sheets therein. These sheet detecting sensors are each connected to the control unit 201 to notify the control unit 201 of the presence/absence of sheets. The CPU 202 knows the presence/absence of sheets in each of the sheet feeding cassettes 125 to 128 and the sheet feeding tray 160 according to the notifications from the sheet detecting sensors.

Figure 3:
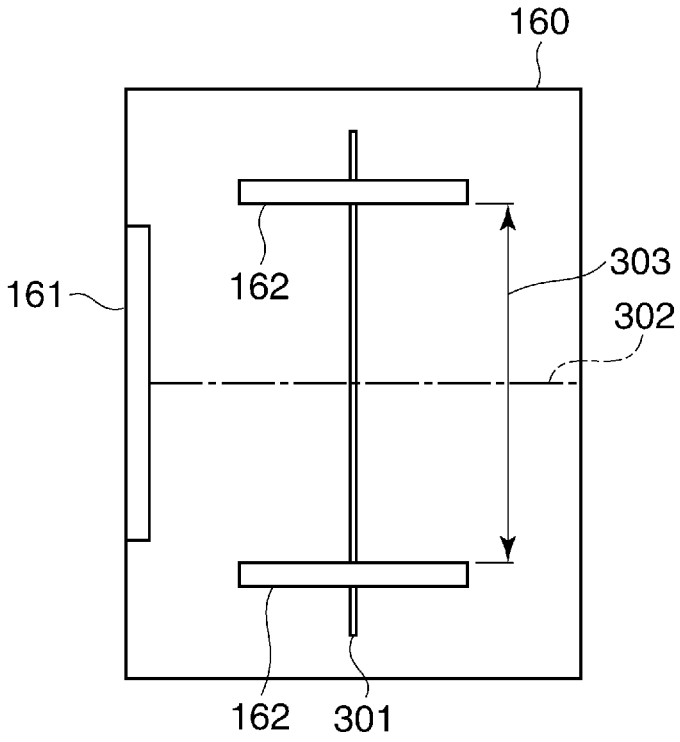
FIG. 3 is a schematic view of a manual sheet feeding tray provided in the image forming apparatus shown in FIG. 1.

FIG. 3 is a schematic view of the manual sheet feeding tray 160 provided in the image forming apparatus 100 shown in FIG. 1.

FIG. 3 illustrates the arrangement of the manual sheet feeding tray 160, as viewed from above. The manual sheet feeding tray 160 feeds sheets placed on the manual sheet feeding tray 160 one by one using the feed roller 161. The manual sheet feeding tray 160 includes the guides 162 for feeding the sheets straight to the printer section 170. The guides 162 can be moved manually on a rail 301 in a vertical direction, as viewed in FIG. 3, with reference to a center line 302 positioned in the center. A width 303 is automatically detected by a width detecting sensor (not shown) as the width (lateral length) of the sheets placed on the manual sheet feeding tray 160.

Figure 4:
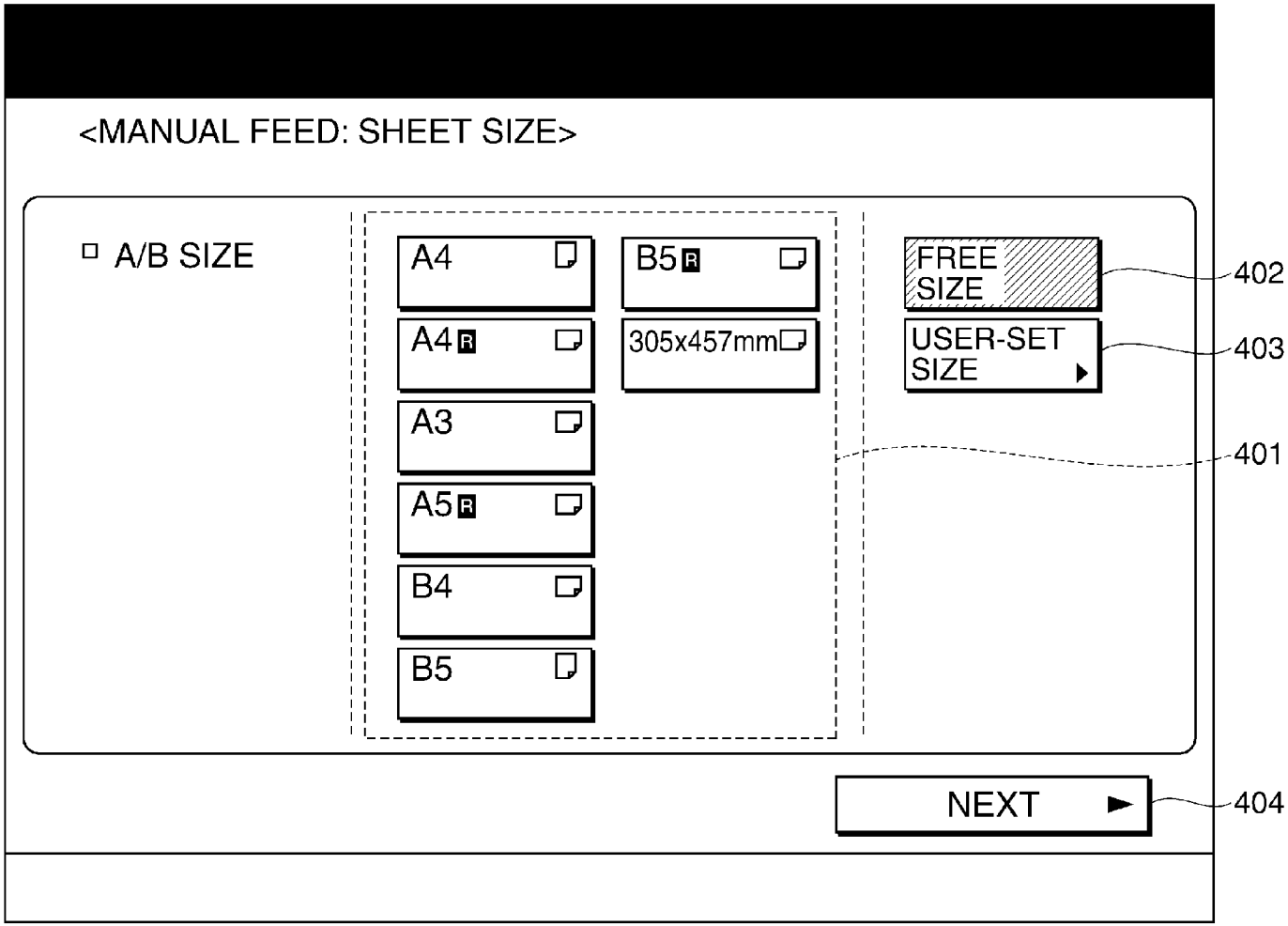
FIG. 4 is a view showing an example of a sheet size-setting screen displayed on a console section of the image forming apparatus shown in FIG. 2.

FIG. 4 is a view showing an example of a sheet size-setting screen (one for sheets in the manual sheet feeding tray 160) displayed on the console section 205 of the image forming apparatus 100 shown in FIG. 2. In the following description, a non-standard size in which the vertical and lateral lengths of a sheet are designated by a user is referred to as a "user-defined size", whereas a non-standard size in which the vertical and lateral lengths of a sheet are not designated by the user is referred to as a "free size".

Referring to FIG. 4, the illustrated sheet size-setting screen is displayed on the liquid crystal panel of the console section 205 appearing in FIG. 2. A standard size sheet-selecting key group 401 is displayed on the sheet size-setting screen. To select sheets defined in advance in the image forming apparatus 100, it is possible to select one of keys of the standard size sheet-selecting key group 401 to thereby set a size of standard size sheets in the manual sheet feeding tray 160.

Further, a free size-setting key 402 is displayed on the sheet size-setting screen. This free size-setting key 402 is pressed when the manual sheet feeding tray 160 is set to a free size in which the vertical and lateral lengths of non-standard size sheets are not input or designated by the user. In a case where a free size is set, when sheets are placed on the manual sheet feeding tray 160, the width (lateral length) of the sheet is automatically detected by the width sensor that detects the width 303 between the guides 162 appearing in FIG. 3. As described hereinabove, when a first sheet is fed, a time period during which the first sheet passes through the sheet detecting sensor 180 is measured to thereby automatically detect the vertical length of the sheet along the sheet-conveying direction. This makes it possible to determine the vertical and lateral lengths of the second and following non-standard size sheets placed on the manual sheet feeding tray 160.

Further, a user-set size key 403 is displayed on the sheet size-setting screen. This user-set size key 403 is used by the user when the user inputs the values of the vertical and lateral lengths of non-standard size sheets placed on the manual sheet feeding tray 160. In the illustrated example of the present embodiment, non-standard size sheets the vertical and lateral lengths of which have been set using the user-set size key 403 are referred to as the "user-defined size sheets". When the user-set size key 403 is pressed, the screen is switched to an input screen (FIG. 5) for use in inputting the vertical and lateral lengths of the non-standard size sheets.

Further, a switch key 404 for switching the screen to the next screen is displayed on the sheet size-setting screen. Although the next screen is not displayed here, when the switch key 404 is pressed, the screen is switched to a screen for use in setting the types of sheets and the like.

In the image forming apparatus 100 shown in FIG. 1, non-standard size sheets can also be accommodated in the sheet feeding cassettes 127 and 128. When non-standard size sheets are accommodated in at least one of the sheet feeding cassettes 127 and 128, the configuration of a non-standard size sheet is performed on a screen similar to the sheet size-setting screen described with reference to FIG. 4.

In the present embodiment, however, it is impossible to set a free size for the sheet feeding cassettes 127 and 128. Non-standard sizes which can be set for the sheet feeding cassettes 127 and 128 are only user-defined sizes. As a consequence, on a screen displayed for setting a size of sheets accommodated in the sheet feeding cassettes 127 and 128 (i.e. a sheet size-setting screen), a key corresponding to the free size-setting key 402 as appearing in FIG. 4 is not displayed.

Figure 5:
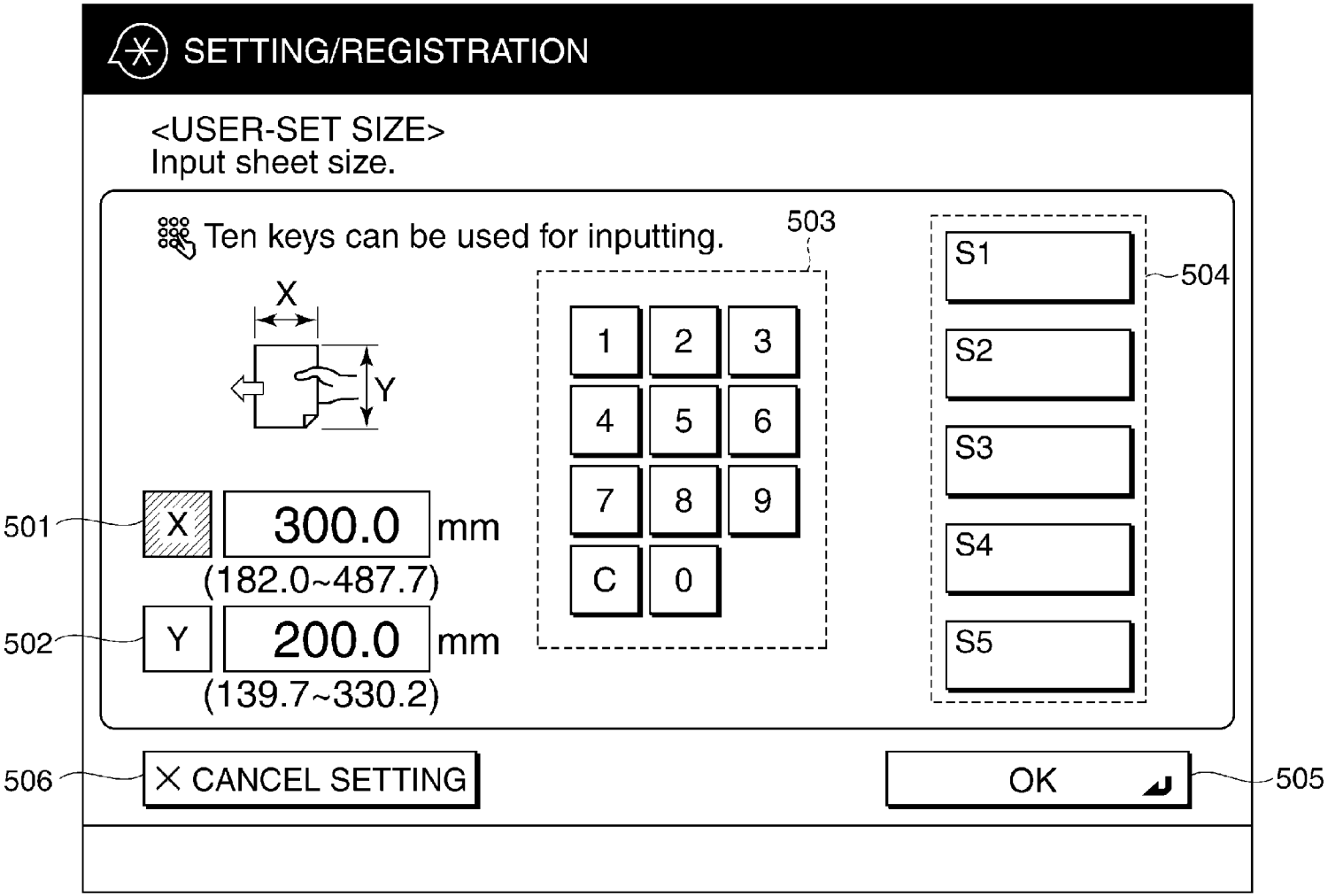
FIG. 5 is a view showing an example of a user-defined size-setting screen displayed on the console section of the image forming apparatus shown in FIG. 2.

FIG. 5 is a view showing an example of a user-defined size-setting screen displayed on the console section 205 of the image forming apparatus shown in FIG. 2.

Referring to FIG. 5, the illustrated user-defined size-setting screen is displayed on the liquid crystal panel of the console section 205 appearing in FIG. 2. The user-defined size-setting screen is used for setting a user-defined size for a selected one of the sheet feeders. In setting the vertical and lateral lengths of sheets on the user-defined size-setting screen, the user inputs the lateral length of the sheets in a lateral size section 501 by using ten keys 503. Then, similarly, by using the ten keys 503, the user inputs the vertical length of the sheets in a vertical size section 502. This makes it possible to set the user-defined sizes in the manual sheet feeding tray 160 and the sheet feeding cassettes 127 and 128 appearing in FIG. 1.

Although in the example illustrated in FIG. 5, the user-defined sizes are designated in units of millimeters, the user-defined sizes may be designated in units of other length units, such as inches. User-defined size one-touch keys 504 are displayed on the user-defined size-setting screen. For the user-defined size one-touch keys 504, it is possible to register maximum five user-defined sizes each set by the lateral size section 501 and the vertical size section 502, in the control unit 201 (FIG. 2). When one of the user-defined size one-touch keys 504 is pressed, an associated one of the user-defined sizes registered in the control unit 201 is called.

Further, an OK key 505 and a cancel key 506 are displayed on the user-defined size-setting screen. The OK key 505 is pressed for finally determining a user-defined size set on the user-defined size-setting screen. When the cancel key 506 is pressed, the control unit 201 cancels the user-defined size set on the user-defined size-setting screen to display an immediately preceding screen displayed before the user-defined size-setting screen, on the liquid crystal panel.

Figure 6:
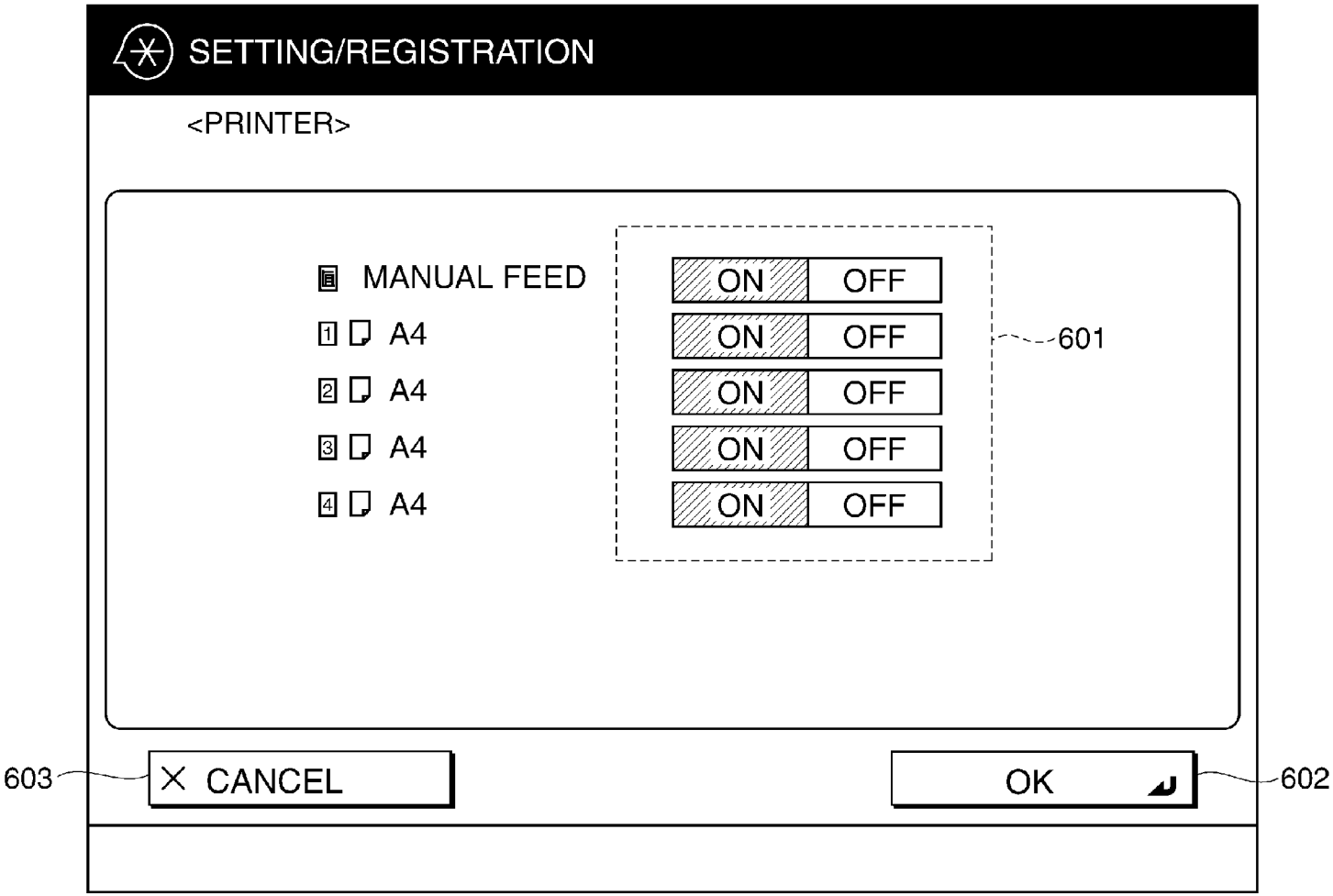
FIG. 6 is a view showing an example of a sheet feeder-setting screen displayed on the console section of the image forming apparatus shown in FIG. 2.

FIG. 6 is a view showing an example of a sheet feeder-setting screen displayed on the console section 205 of the image forming apparatus 100 shown in FIG. 2, for setting sheet feeders for automatic sheet selection.

Referring to FIG. 6, the illustrated sheet feeder-setting screen is displayed on the liquid crystal panel of the console section 205 appearing in FIG. 2. Here, the term "automatic sheet selection" is intended to mean feeding sheets by automatically selecting one of the sheet feeders which accommodates sheets having a best-suited size according to an image size of image data input to the image forming apparatus 100 (or read by the image forming apparatus 100). In the automatic sheet selection, a sheet having vertical and lateral lengths that match those of a standard size is handled as a standard size sheet, whereas a sheet having vertical and lateral lengths that do not match those of any standard size is handled as a non-standard size sheet.

On the sheet feeder-setting screen, selection keys 601 each make it possible to set whether or not an associated one of the sheet feeders provided in the image forming apparatus 100 is to be used as one for automatic sheet selection. If a sheet feeder is set to "ON" by pressing an associated "ON" key of the selection keys 601, the sheet feeder is designated as one for automatic sheet selection. If image data with no designation of any of the sheet feeders is input to the image forming apparatus 100, the sheet feeder is selected as one of objects to be checked for determining whether or not sheets accommodated therein have the best-suited size.

On the other hand, if one of the sheet feeders is set to "OFF" by an associated "OFF" key of the selection keys 601, the sheet feeder is no longer an object for automatic sheet selection, and unless the sheet feeding cassette is designated as one for automatic sheet selection, sheets accommodated therein are not automatically selected for feeding therefrom.

On the sheet feeder-setting screen, when an OK key 602 is pressed, the setting of sheet feeding cassettes for automatic sheet selection, performed on the screen, is finally determined. On the other hand, when a cancel key 603 is pressed, the setting of the sheet feeding cassettes for the automatic sheet selection, performed on the sheet feeder-setting screen, is canceled, and the screen returns to the immediately preceding screen.

Figure 7:
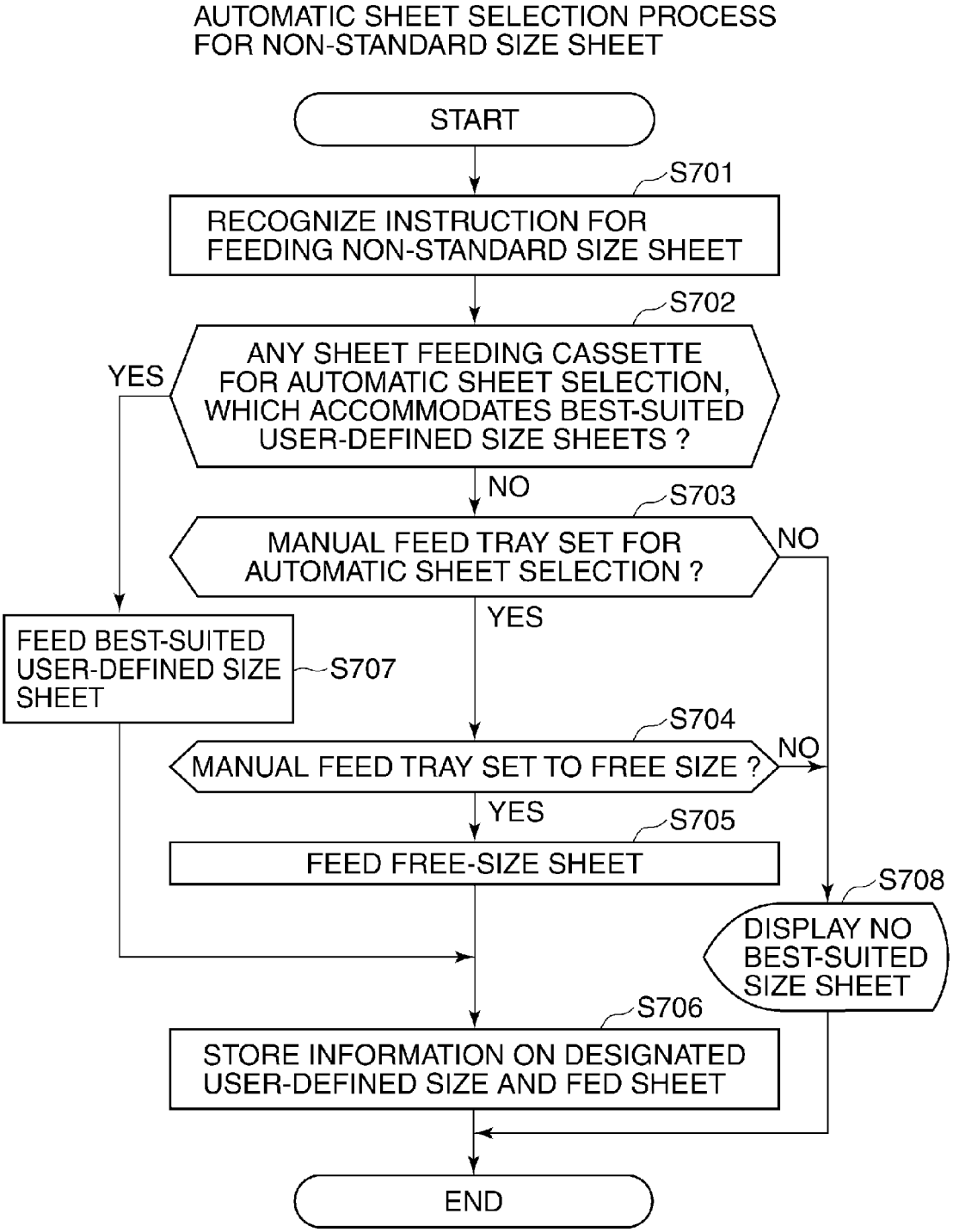
FIG. 7 is a flowchart of an automatic sheet selection process for non-standard size sheets, which is performed by the image forming apparatus shown in FIG. 1, for automatically selecting and feeding non-standard size sheets.

FIG. 7 is a flowchart of an automatic sheet selection process for non-standard size sheets, which is performed by the image forming apparatus 100 shown in FIG. 1, for automatically selecting and feeding non-standard size sheets.

Referring to FIGS. 1, 2, and 7, a description will be given of the FIG. 7 automatic sheet selection process which is executed on image data input to the image forming apparatus 100 on a page-by-page basis. Particularly in the case of a print job received from the host computer 208, an application or a printer driver of the host computer 208 can designate a sheet size, a sheet type, and a sheet feeder, on a page-by-page basis. Therefore, it is necessary to determine a best-suited sheet size on a page-by-page basis.

In the automatic sheet selection for non-standard size sheets, the CPU 202 recognizes that an image to be printed next has a non-standard size (step S701). Then, the CPU 202 searches the sheet feeding cassettes set on the sheet feeder-setting screen (FIG. 6) as objects for the automatic sheet selection, for a sheet feeding cassette accommodating non-standard size sheets having the same vertical and lateral lengths as those of the non-standard size of the image to be printed next (step S702). If there is no sheet feeding cassette accommodating non-standard size sheets having the same vertical and lateral lengths as those of the non-standard size sheet which is designated for a page, currently being processed, of the print job (NO to the step S702), the CPU 202 proceeds to a step S703, and determines whether or not the manual sheet feeding tray 160 has been set e.g. on the screen shown in FIG. 6 as a sheet feeder for the automatic sheet selection (step S703).

If the manual sheet feeding tray 160 is set as a sheet feeder for the automatic sheet selection (YES to the step S703), the CPU 202 determines whether or not the manual sheet feeding tray 160 has been set to the free size (step S704). If the manual sheet feeding tray 160 has been set to the free size (YES to the step S704), the CPU 202 causes the printer section 170 to feed one of the free-size sheets from the manual sheet feeding tray 160 (step S705).

After that, the CPU 202 stores information on the non-standard size sheet fed in the step S705 and the sheet feeder from which the non-standard size sheet was fed, in the HDD 203 (step S706). This terminates processing of the present process for one page.

In the step S702, if there is a sheet feeding cassette accommodating non-standard size sheets having the same vertical and lateral lengths as those of the sheet designated for the page (YES to the step S702), the CPU 202 proceeds to a step S707, wherein the printer section 170 is caused to feed one of the user-defined size sheets from the sheet feeding cassette. Then, the CPU 202 proceeds to the step S706, wherein the CPU 202 stores information on the user-defined size sheet fed in the step S707 and the sheet feeder from which the user-defined size sheet was fed, in the HDD 203. This terminates processing of the present process for one page.

In the step S703, if the manual sheet feeding tray 160 is not set as a sheet feeder for the automatic sheet selection (NO to the step S703), the CPU 202 proceeds to a step S708, wherein the CPU 202 causes a screen indicating that there is no best-suited sheet size (no-best-suited size notice screen) to be displayed on the liquid crystal panel of the console section 205 (step S708). This terminates processing of the present process for one page. Note that the no-best-suited size notice screen displays a best-suited user-defined size.

In the step S704, if the manual sheet feeding tray 160 has not been set to the free size (NO to the step S704), the CPU 202 proceeds to the step S708, wherein the no-best-suited size notice screen is displayed on the liquid crystal panel of the console section 205. This terminates processing of the present process for one page.

As described above, in a case where an image to be printed is for a non-standard size, if there is any sheet feeding cassette accommodating non-standard size sheets having vertical and lateral lengths that match those of the image for the non-standard size, it is possible to select the sheet feeding cassette for feeding one of the non-standard size sheets therefrom. This makes it possible to print a image on a sheet having a size as desired by the user as possible. Further, even if there are no sheet feeding cassettes accommodating non-standard size sheets having vertical and lateral lengths matching those of the image for the non-standard size, if the manual sheet feeding tray accommodating non-standard size sheets has been set to the free-size sheet, it is possible to continue printing using one of the sheets accommodated therein. This makes it possible to prevent stoppage of printing the image.

As described hereinabove, in the automatic sheet selection process described with reference to FIG. 7, information on a non-standard size designated for a page, a non-standard size sheet actually fed, and a sheet feeder from which the non-standard size sheet was fed is stored in the HDD 203. Therefore, in the same print job, when there are non-standard size sheets having the same vertical length and the same lateral length, the CPU 202 is only required to feed sheets from the same sheet feeder, whereby it is possible to omit part of the automatic sheet selection process shown in FIG. 7.

Figure 8:
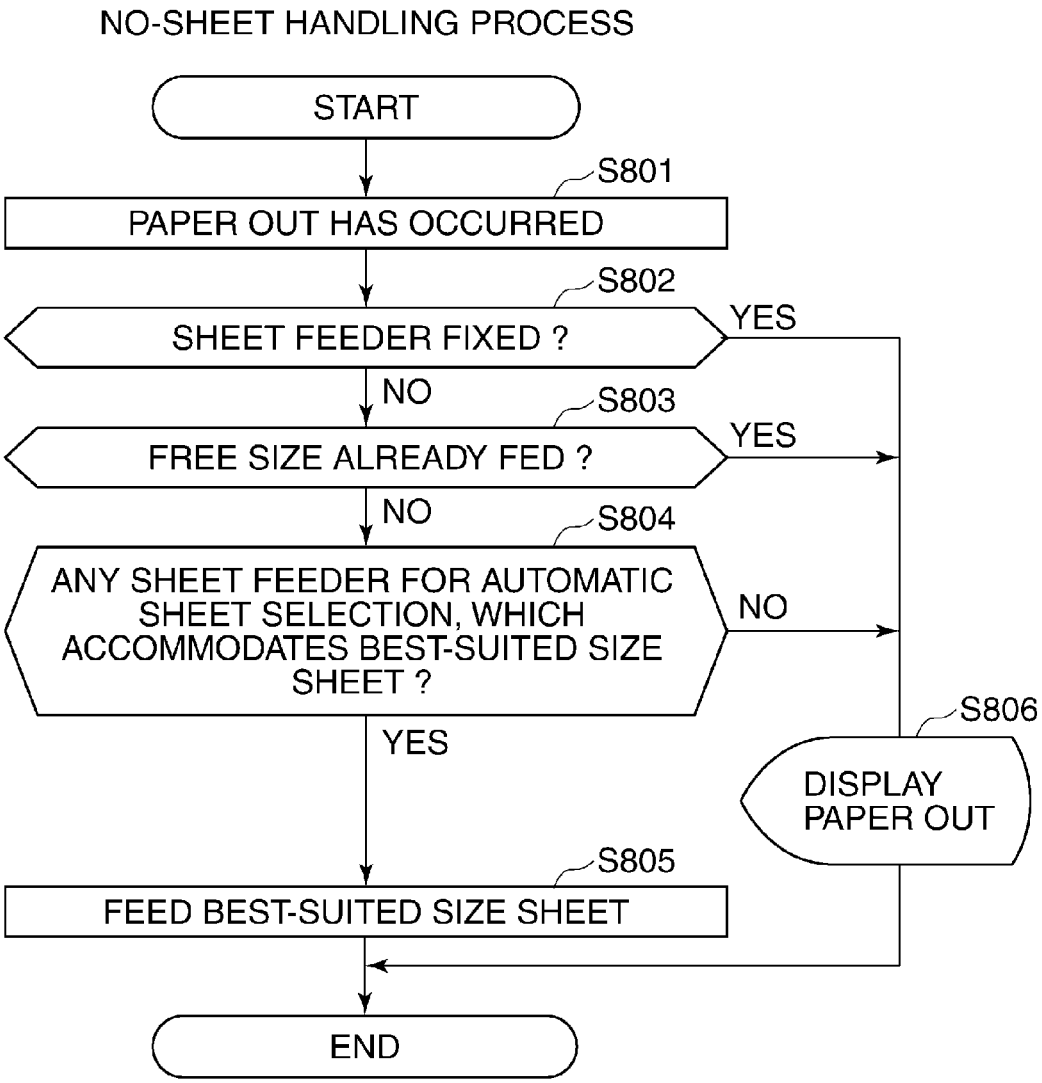
FIG. 8 is a flowchart of a no-sheet handling process which is carried out when the image forming apparatus shown in FIG. 1 has run out of non-standard size sheets.

FIG. 8 is a flowchart of a no-sheet handling process which is carried out when the image forming apparatus 100 shown in FIG. 1 has run out of non-standard size sheets. The no-sheet handling process shown in FIG. 8 is executed in a case where when a non-standard size sheet information on which has been stored by the FIG. 7 automatic sheet selection process in the HDD 203 is about to be fed, no sheets are accommodated in a sheet feeder associated with the non-standard size sheet.

Referring to FIGS. 1, 2, and 8, the CPU 202 detects that there is no non-standard size sheet information on which has been stored by the FIG. 7 automatic sheet selection process in the HDD 203. That is, the CPU 202 judges that paper out has occurred (step S801). Then, the CPU 202 determines whether or not designation of a sheet feeder has been performed on image data which is about to be printed (step S802). Here, the term "designation of a sheet feeder" is intended to mean designating a sheet size and a sheet feeder for thereby feeding a sheet of the designated sheet size from the designated sheet feeder without performing automatic sheet selection.

If the designation of a sheet feeder has not been performed (NO to the step S802), the CPU 202 determines whether or not the sheet size on which information has been stored in the HDD 203 is the free size (step S803). If the sheet size on which information has been stored in the HDD 203 is not the free size (NO to the step S803), the CPU 202 searches for a sheet feeder for automatic sheet selection, which accommodates sheets having best-suited vertical and lateral lengths (step S804). If there is a sheet feeder for automatic sheet selection, which accommodates sheets having best-suited vertical and lateral lengths (YES to the step S804), the CPU 202 causes the printer section 170 to feed one of the sheets from the sheet feeder (step S805). Then, the CPU 202 terminates processing of the present process for one page.

In the step S802, if the designation of a sheet feeder has been performed (YES to the step S802), the CPU 202 indicates "paper out" on the liquid crystal panel of the console section 205 (step S806), and prompts the user to replenish sheets in the designated sheet feeder. Since sheets of best-suited size are originally accommodated in this designated sheet feeder (sheet feeder where paper out has occurred), the CPU 202 indicates this fact on the liquid crystal panel to prompt the user to replenish the sheets of best-suited size. Then, the CPU 202 terminates processing for one page.

Similarly, in the step S803, if the sheet size stored in the HDD 203 is free size (YES to the step S803), the CPU 202 proceeds to the step S806 to indicate the fact of "paper out" on the liquid crystal panel of the console section 205 (step S806).

Once free-size sheets starts to be fed, even if sheets of the best-suited user-defined size are accommodated in another sheet feeder, the free-size sheets can continue to be fed. However, execution of the processing described in the step S803 makes it possible, when the sheet size has been set to the free size, to prevent an image for the same non-standard size from being printed on a sheet of a different size in the course of a print job.

Further, in the step S804, if there are no sheets of best-suited size (NO to the step S804), the CPU 202 proceeds to the step S806 to indicate "paper out" on the liquid crystal panel of the console section 205.

By carrying out the above described control, it is possible to prevent creation of a printed product which is not desired by the user. Specifically, when the user desires to print an image using a type of non-standard size sheets, it is possible to prevent two or more types of non-standard size sheets from being used for printed products made by execution of a print job.

Next, a description will be given of a second embodiment of the present invention. The hardware of an image forming apparatus according to the second embodiment is the same as that of the image forming apparatus according to the first embodiment. Therefore, elements corresponding to those in the first embodiment are denoted by identical reference numerals, and description thereof is omitted. Hereinafter, a description will be given of different points from the first embodiment.

In the above-described first embodiment, in the case where there are no sheet feeding cassettes accommodating non-standard size sheets of a best-suited size, and at the same time the free size is designated for the manual sheet feeding tray 160, the CPU 202 necessarily feeds free-size sheets from the manual sheet feeding tray 160.

In this case, if a print job includes images of respective different non-standard sizes having different vertical and lateral lengths from each other, there is a fear that sheets of the same free size are fed for the respective images of the different non-standard sizes. To prevent such an inconvenience, once a sheet of a free size is fed for an image of a non-standard size, the CPU 202 performs control such that a sheet of the free size is not fed for an image of a different non-standard size.

Figure 9:
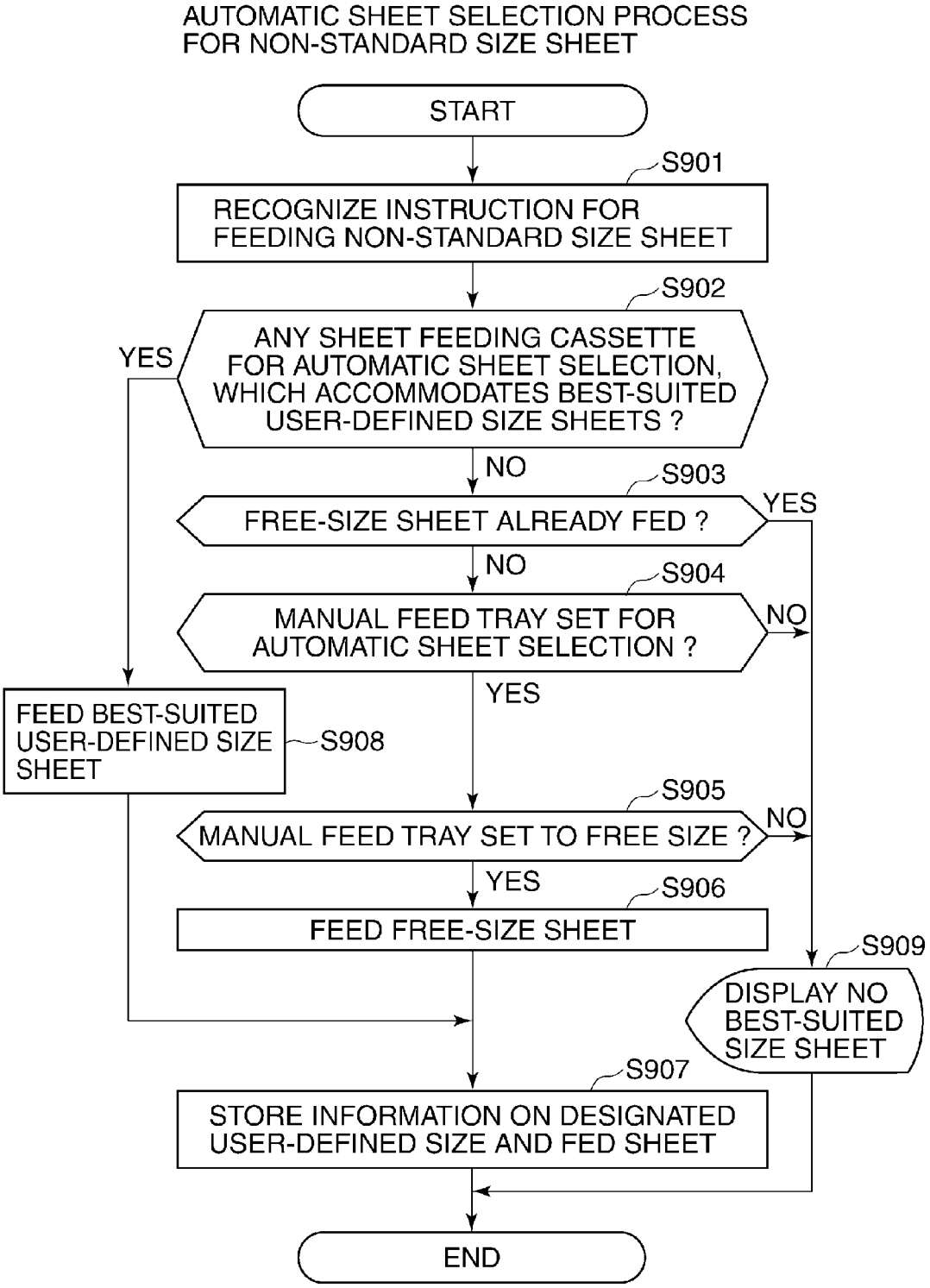
FIG. 9 is a flowchart of an automatic sheet selection process for non-standard size sheets, which is performed by the image forming apparatus shown in FIG. 1, for automatically selecting and feeding non-standard size sheets.

FIG. 9 is a flowchart of an automatic sheet selection process for non-standard size sheets, which is performed by the image forming apparatus 100 shown in FIG. 1, for automatically selecting and feeding non-standard size sheets.

Referring to FIGS. 1, 2, and 9, here, the automatic sheet selection process shown in FIG. 9 is carried out on image data input to the image forming apparatus 100 on a page-by-page basis. In the automatic sheet selection for automatically selecting and feeding non-standard size sheets, the CPU 202 recognizes that an image that to be printed next has a non-standard size (step S901). Then, searches the sheet feeding cassettes set on the sheet feeder-setting screen (FIG. 6) as objects for the automatic sheet selection, for a sheet feeding cassette accommodating non-standard size sheets having the same vertical and lateral lengths as those of the non-standard size of the image to be printed next (step S902).

If there is no sheet feeding cassette accommodating non-standard size sheets having the same vertical and lateral lengths (NO to the step S902), the CPU 202 proceeds to a step S903, wherein the CPU 202 determines whether or not a free-size sheet has already been fed from the manual sheet feeding tray 160 during execution of the print job.

If no free-size sheet has already been fed from the manual sheet feeding tray 160 during execution of the print job (NO to the step S903), the CPU 202 determines whether or not the manual sheet feeding tray 160 has been set as a sheet feeding cassette for the automatic sheet selection (step S904).

If the manual sheet feeding tray 160 has been set as a sheet feeding cassette for the automatic sheet selection (YES to the step S904), the CPU 202 determines whether or not the manual sheet feeding tray 160 has been set to the free size (step S905). If the manual sheet feeding tray 160 has been set to the free size (YES to step S905), the CPU 202 causes the printer section 170 to feed one of the free-size sheets from the manual sheet feeding tray 160 (step S906).

After that, the CPU 202 stores information on the non-standard size sheet fed in the step S906 and the sheet feeder from which the non-standard size sheet was fed, in the HDD 203 (step S907). This terminates processing of the present process for one page.

In the step S902, if there is a sheet feeding cassette accommodating non-standard size sheets having the same vertical and lateral lengths as those of the sheet designated for the page (YES to the step S902), the CPU 202 proceeds to a step S908, wherein the printer section 170 is caused to feed one of the user-defined size sheets from the sheet feeding cassette. Then, the CPU 202 proceeds to the step S907, wherein the CPU 202 stores information on the user-defined size sheet fed in the step S908 and the sheet feeder from which the user-defined size sheet was fed, in the HDD 203. This terminates processing of the present process for one page.

In the step S903, if a free-size sheet has already been fed from the manual sheet feeding tray 160 during execution of the print job (YES to the step S903), judging that there is no sheet feeder accommodating sheets of a best-suited size, the CPU 202 proceeds to a step S909, wherein the CPU 202 displays a screen indicating that there is no sheets of a best-suited size (no-best-suited size notice screen) on the liquid crystal panel of the console section 205. This terminates processing of the present process for one page. Note that the no-best-suited size notice screen displays a best-suited user-defined size.

In the step S904, if the manual sheet feeding tray 160 has not been set as a sheet feeding cassette for the automatic sheet selection (NO to the step S904), the CPU 202 proceeds to the step S909, wherein the CPU 202 displays the no-best-suited size notice screen on the liquid crystal panel of the console section 205. This terminates processing of the present process for one page.

Further, in the step S905, if the manual sheet feeding tray 160 has not been set to free size (NO to step S905), the CPU 202 proceeds to the step S909, wherein the CPU 202 displays the no-best-suited size notice screen on the liquid crystal panel of the console section 205. This terminates processing of the present process for one page.

As described above, in the automatic sheet selection process described with reference to FIG. 9, the processing described in the step S903 makes it possible to prevent sheets of the same free size from being fed for images of different non-standard sizes having vertical and lateral lengths different from each other during one print job.

Note that in the automatic sheet selection process described with reference to FIG. 9 as well, information on a non-standard size designated for a page, a non-standard size sheet actually fed, and a sheet feeder from which the non-standard size sheet was fed is stored in the HDD 203. Therefore, in the same print job, when there are non-standard size sheets having the same vertical length and the same lateral length, the CPU 202 is only required to feed sheets from the same sheet feeder, whereby it is possible to omit part of the automatic sheet selection process shown in FIG. 9.

Although in the above-described first and second embodiments, the color modes for image formation are not particularly described, by taking into account the fact that printing of color images has a high possibility of scattering toners if feeding of free-size sheets is performed, the processes described above in the first and second embodiments may be executed only on monochrome images. In this case, as for color images, the automatic sheet selection is performed only from sheet feeders accommodating sheets of user-defined sizes.

As described hereinabove, in the first and second embodiments, it is possible not only to automatically feed sheets of user-defined sizes but also to automatically feed sheets of a free size, for a print job that designates non-standard size sheets. This makes it possible to feed sheets of a best-suited size for non-standard size image data while saving the user the trouble of designating a sizes of sheets.

Further, in the first and second embodiments, in a case where printing is performed while switching between sheet feeders depending on the presence/absence of sheets accommodated therein, sheets of best-suited size are fed for printing non-standard size image data. Furthermore, during feeding of sheets of a free size, if the apparatus has run out of the sheets of the free size, the user is notified of the fact, whereby even when a sheet feeder accommodates sheets of user-defined sizes, switching of the sheet feeder is inhibited. This makes it possible to prevent the sheet size for the non-standard size image data from being changed in the course of one print job.

As is apparent from the above description, the console section 205 and the CPU 202 serve as a first size designation unit, a second size designation unit, a third size designation unit, and a sheet feed control unit.

Although a description has been given of the embodiments of the present invention, the present invention is by no means limited to the above-described embodiments, but it includes various forms insofar as they do not depart from the spirit and scope thereof.

For example, by using the functions of the above-described embodiments as a sheet feed control method, it is possible to cause the image forming apparatus to execute the method. Further, a computer provided in the image forming apparatus may be caused to execute a computer-executable program implementing the sheet feed control method. In doing this, the sheet feed control method includes at least a first size designation step, a second size designation step, a third size designation step, and a sheet feed control step.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2010-151105 filed Jul. 1, 2010, which is hereby incorporated by reference herein in its entirety.

What is claimed is:

1. An image forming apparatus for feeding a recording sheet from one of a plurality of sheet storage units and forming an image on the fed recording sheet, comprising:

a first designation unit configured to designate vertical and lateral lengths of a recording sheet for a sheet storage unit included in the plurality of sheet storage units;

a second designation unit configured to designate a predetermined size without designating vertical and lateral lengths of a recording sheet for a sheet storage unit included in the plurality of sheet storage units; and a determining unit configured to determine whether there is a sheet storage unit for which vertical and lateral lengths corresponding to vertical and lateral lengths of a recording sheet on which the image is to be formed are designated; and a sheet feed control unit configured to control to feed, in a case where the determining unit determines that there is the sheet storage unit for which vertical and lateral lengths corresponding to vertical and lateral lengths of a recording sheet on which the image is to be formed are designated by the first designating unit, a recording sheet from the sheet storage unit for which the vertical and the lateral lengths are designated by the first desingnating unit, and to control to feed, in a case where the determining unit determines that there is not a sheet storage unit for which the vertical and lateral lengths corresponding to the vertical and lateral lengths of a recording sheet on which the image is to be formed are designated, a recording sheet from a sheet storage unit for which the predetermined size is designated by the second designating unit.

2. The image forming apparatus according to claim 1, wherein in a case where said sheet feed control unit starts to feed the recording sheet from the sheet storage unit for which the predetermined size is designated by the second designating unit, said sheet feed control unit controls to feed the recording sheet from the sheet storage unit for which the predetermined size is designated by the second designating unit until one print job is terminated.

3. The image forming apparatus according to claim 1, further comprising a detection unit configured to detect whether amount of recording sheets stored in the sheet storage unit for which the predetermined size is designated by the second designating unit reaches zero, wherein in a case where said sheet feed control unit feeds the recording sheet from the sheet storage unit for which the predetermined size is designated, said sheet feed control unit performs notification for prompting a user to set the recording sheet when the detection unit detects the amount of the recording sheets reaches zero.

4. The image forming apparatus according to claim 1, wherein said sheet feed control unit feeds the recording sheet from the sheet storage unit for which the predetermined size is designated in a case where the image to be formed is a monochrome image.

5. A sheet feed control method for an image forming apparatus for feeding a recording sheet from one of a plurality of sheet storage units and forming an image on the fed recording sheet, comprising:

designating vertical and lateral lengths of a recording sheet for a sheet storage unit included in the plurality of sheet storage units;

designating a predetermined size without designating vertical and lateral lengths of a recording sheet for a sheet storage unit included in the plurality of sheet storage units; and determining whether there is a sheet storage unit for which vertical and lateral lengths corresponding to vertical and lateral lengths of a recording sheet on which the image is to be formed are designated; and controlling to feed in a case where it is determined that there is a sheet storage unit for which vertical and lateral lengths corresponding to vertical and lateral lengths of a recording sheet on which the image is to be formed is designated, a recording sheet from the sheet storage unit for which the vertical and the lateral lengths are designated, and controlling to feed, in a case where it is determined that there is not a sheet storage unit for which the vertical and lateral lengths corresponding to the vertical and lateral lengths of a recording sheet on which the image is to be formed are designated, a recording sheet from a sheet storage unit for which the predetermined size is designated.

6. A non-transitory computer-readable storage medium storing a computer-executable program for causing a computer to execute a sheet feed control method for an image forming apparatus for feeding a recording sheet from one of a plurality of sheet storage units and forming an image on the fed recording sheet, wherein the sheet feed control method comprises:

designating vertical and lateral lengths of a recording sheet for a sheet storage unit included in the plurality of sheet storage units;

designating a predetermined size without designating vertical and lateral lengths of a recording sheet for a sheet storage unit included in the plurality of sheet storage units; and determining whether there is a sheet storage unit for which vertical and lateral lengths corresponding to vertical and lateral lengths of a recording sheet on which the image is to be formed are designated; and controlling to feed, in a case where it is determined that there is a sheet storage unit for which vertical and lateral lengths corresponding to vertical and lateral lengths of a recording sheet on which the image is to be formed is designated, a recording sheet from the sheet storage unit for which the vertical and the lateral lengths are designated, and controlling to feed, if it is determined that there is not a sheet storage unit for which the vertical and lateral lengths corresponding to the vertical and lateral lengths of a recording sheet on which the image is to be formed are designated, a recording sheet from a sheet storage unit for which the predetermined size is designated.

* * * * *